US009308768B2

(12) United States Patent
Lin

(10) Patent No.: US 9,308,768 B2
(45) Date of Patent: Apr. 12, 2016

(54) RING CLAMP

(71) Applicant: Dongguan Humen NanZha World Wide Stationery MFG Co., Ltd., Dongguan, Guangdong Province (CN)

(72) Inventor: Chunhai Lin, Dongguan (CN)

(73) Assignee: Dongguan Humen Nanzha World Wide Stationery Mfg. Co., Ltd., Dongguan (CN)

( * ) Notice: Subject to any disclaimer, the term of this patent is extended or adjusted under 35 U.S.C. 154(b) by 96 days.

(21) Appl. No.: 14/135,946

(22) Filed: Dec. 20, 2013

(65) Prior Publication Data

US 2014/0186094 A1 Jul. 3, 2014

(30) Foreign Application Priority Data

Dec. 27, 2012 (CN) ..... 2012 1 0577826

(51) Int. Cl.
*B42F 13/22* (2006.01)
*B42F 13/26* (2006.01)

(52) U.S. Cl.
CPC ..... *B42F 13/26* (2013.01); *B42F 13/22* (2013.01)

(58) Field of Classification Search
CPC ..... B42F 13/22; B42F 13/26
USPC ..... 402/30–31, 503
See application file for complete search history.

(56) References Cited

U.S. PATENT DOCUMENTS

| | | | | |
|---|---|---|---|---|
| 3,032,040 | A * | 5/1962 | Wakeman | B42F 13/12 402/34 |
| 3,116,737 | A * | 1/1964 | Kelly, Jr. | B42F 13/24 402/30 |
| 2006/0251467 | A1* | 11/2006 | Cheng | B42F 13/26 402/31 |
| 2008/0075526 | A1 | 3/2008 | Ng et al. | |
| 2009/0060631 | A1* | 3/2009 | To | B42F 13/26 402/31 |
| 2011/0170942 | A1* | 7/2011 | Huang | B42F 13/26 402/31 |

FOREIGN PATENT DOCUMENTS

| | | |
|---|---|---|
| CN | 2702855 Y | 6/2005 |
| CN | 101152811 A | 4/2008 |
| CN | 20303218 U | 7/2013 |

* cited by examiner

*Primary Examiner* — Kyle Grabowski
(74) *Attorney, Agent, or Firm* — McDonnell Boehnen Hulbert & Berghoff LLP

(57) ABSTRACT

A novel ring clamp, which comprises a housing, an articulated plate, rings, a handle and a slide plate, wherein the handle or the slide plate is provided with an idle stroke section, so that the slide plate does not slide towards a locking position along with the closing of the handle in the initial phase of the closing of the ring clamp; the articulated plate can cross a coplanar position along with the closing of the handle so as to close the clamp; the ring clamp is provided with a magnetic structure; and after the articulated plate crosses the coplanar position along with the closing of the handle so as to close the clamp, the slide plate is adsorbed to the locking position by the magnetic force, so that the articulated plate can be locked.

9 Claims, 12 Drawing Sheets

RING CLAMP

FIELD OF THE INVENTION

The present invention relates to the field of fixtures for filing appliances, in particular to a novel ring clamp.

BACKGROUND OF THE INVENTION

Ring clamps are usually fixed on filing appliances or notebooks. When the ring clamp is in the opened state, perforated loose-leaf paper can be added or removed. When the ring clamp is in the closed state, the loose-leaf paper is sleeved into rings of the ring clamp and can turn over along the rings.

The Chinese patent titled "ring clamp structure" (the patent application number: 200710129155.5) discloses a ring structure for retaining loose-leaf paper, which comprises a housing and articulated plates which are supported by the housing to perform pivoting movement relative to the housing, wherein ring members are mounted on the articulated plates and can move between closed positions and opened positions; an actuator is mounted on the housing and configured to move relative to the housing, so that the pivoting movement of the articulated plates can be achieved; locking members are configured to lock the released and closed ring members at locking positions, and the released and closed ring members are driven to move to opened positions of unlocked positions; and an intermediate connector is configured to operably connect the locking members to the actuator and can be deformed during the movement of the actuator.

When the ring members are closed, an upper lip section of a control handle of the actuator is connected with inner surfaces of the articulated plates; the articulated plates are pulled down, but the elasticity of the housing resists the initial movement of the articulated plates. In addition, a moving rod of the intermediate connector can initially move forwards along with the movement of the upper lip section, so that front edges of the locking members abut against projections of the articulated plates; when the control handle is pivoted continuously, the abutted locking members prevent the moving rod from moving further; a flexible hinge of the intermediate connector begins to be curved, so that the control handle can be pivoted continuously; and due to the relative movement between a connector section of the intermediate connector and the locking members, the tension is generated by the flexible hinge. Once the articulated plates cross the oblique front edges of the locking members, the forward movement of the locking members and the moving rod cannot be resisted again; and at this point, the locking members move to the locking positions thereof behind the articulated plates along with the control handle.

The above patent utilizes the tension generated by the deformation of the intermediate connector to push the locking members to the locking positions, and has the defects that: as each closing action of the ring clamp structure needs to overcome the tension generated by the deformation of the intermediate connector so as to close a ring clamp, the closing action is laborious and the ring clamp is inconvenient to use.

SUMMARY OF THE INVENTION

The objective of the present invention is to overcome the defects in the prior art and provide a ring clamp with labor-saving closing action.

In order to achieve the above objective, the present invention adopts the technical proposal that:

The present invention relates to a novel ring clamp, which comprises a housing, an articulated plate, at least two rings, a handle and a slide plate, wherein the articulated plate consists of a first articulated plate and a second articulated plate which are articulated with each other; an articulated axis is disposed in the middle of the articulated plate; the first articulated plate and the second articulated plate are pivoted relative to the articulated axis; both sides of the articulated plate are connected with the housing; each ring consists of a first ring member and a second ring member; the first ring member and/or the second ring member are/is connected with the articulated plate; when the articulated plate is pivoted, the first ring member and the second ring member are opened or closed along with the pivoting of the articulated plate; after the articulated plate is pivoted towards the outside of the housing and crosses a coplanar position, the first ring member and the second ring member are closed to form a ring; the handle is connected with the housing and can drive the pivoting of the articulated plate; the slide plate is arranged between the housing and the articulated plate, is connected with the handle, and can move relative to the housing; a locking position is disposed on a movement locus; when the ring clamp is in the closed state, the slide plate moves to the locking position and abuts against the articulated plate so as to lock the articulated plate; the slide plate can be departed from the locking position along with the pulling of the handle, so that the articulated plate can be driven to rotate by the handle; the handle or the slide plate is provided with an idle stroke section, so that the slide plate does not slide towards the locking position along with the closing of the handle in the initial phase of the closing of the ring clamp; the ring clamp is provided with a magnetic structure; and after the articulated plate crosses the coplanar position along with the closing of the handle, the slide plate is adsorbed to the locking position by the magnetic force generated by the magnetic structure, so that the articulated plate can be locked.

Preferably, the slide plate includes a connecting rod connected with the handle and a locking member projected on the connecting rod; the locking member includes an abutting section; the articulated plate is provided with a first through hole through which the locking member slides in the direction of an end portion of the articulated plate; and when the ring clamp is in the closed state, the articulated plate abuts against the abutting section, so that the articulated plate is locked and cannot be pivoted.

Preferably, the locking member further includes a buffer section; one end of the buffer section is connected with the connecting rod and the other end of the buffer section is connected with one side of the abutting section away from the handle; and a sliding section which is engaged with the oblique buffer section is disposed on one side of the first through hole close to the buffer section.

Preferably, the handle includes a main body and a handle bar connected with the main body; the main body includes an upper lip section and a lower lip section; both the main body and the housing are provided with a pivoted hole; the ring clamp further comprises a first fixing member; the first fixing member runs through the pivoted holes of the main body and the housing, so that the handle is pivoted with the housing; when the handle bar is pulled out, the lower lip section rotates towards an outer surface of the articulated plate and hence drives the articulated plate to begin pivoting from a position at which the ring clamp is in the closed state; and when the handle bar is closed inwards, the upper lip section is extruded towards an inner surface of the articulated plate and hence drives the articulated plate to cross the coplanar position from the pivoted state so as to close the ring clamp.

Preferably, the idle stroke section is disposed on the main body of the handle and disposed on the upper lip section.

Preferably, the slide plate further includes a tension rod; the idle stroke section is disposed on the connecting rod of the slide plate; and one end of the tension rod is connected with the handle and the other end of the tension rod is connected with the idle stroke section of the connecting rod.

Preferably, a square fixed frame is projected on the connecting rod of the slide plate; the fixed frame and the slide plate are integrally formed; both the slide plate and the fixed frame are made of plastic materials; the ring clamp further comprises a magnetic member disposed on the fixed frame; the fixed frame is formed by four stators; the height of the stator away from the handle is less than that of the magnetic member, and the height of the remaining three stators is greater than that of the magnetic member; the articulated plate is made of ferrous metals and provided with a second through hole through which the fixed frame slides in the direction of the end portion of the articulated plate; and after the articulated plate crosses the coplanar position along with the closing of the handle, the magnetic member is adsorbed to an edge of the second through hole away from the handle.

Preferably, a first adsorbing member is disposed on an end portion of the housing away from the handle; and a second adsorbing member which adsorbs the first adsorbing member mutually is fixed on an end portion of the slide plate facing the first adsorbing member.

Preferably, a rubber magnet support is also disposed on the end portion of the housing away from the handle; the novel ring clamp further comprises a second fixing member configured to fix the rubber magnet support on the housing; the rubber magnet support is provided with a fixing hole; and the magnetic member is fixed in the fixing hole.

The ring clamp provided by the present invention has the advantages that: as the handle or the slide plate is provided with the idle stroke section in the present invention, the slide plate does not slide to the locking position along with the closing of the handle in the initial phase of the closing of the ring clamp, and the articulated plate can cross the coplanar position along with the closing of the handle so as to close the clamp; as the ring clamp is provided with the magnetic structure, after the articulated plate crosses the coplanar position along with the closing of the handle so as to close the clamp, the slide plate is adsorbed to the locking position by the magnetic force, and hence the articulated plate is locked; and therefore, compared with the prior art, the ring clamp provided by the present invention does not need to overcome the tension generated by the deformation of the intermediate connector so as to close the ring clamp, and hence the closing action is more laborsaving and the ring clamp is more convenient to use.

DETAILED DESCRIPTION OF THE PREFERRED EMBODIMENTS

Figure 1:
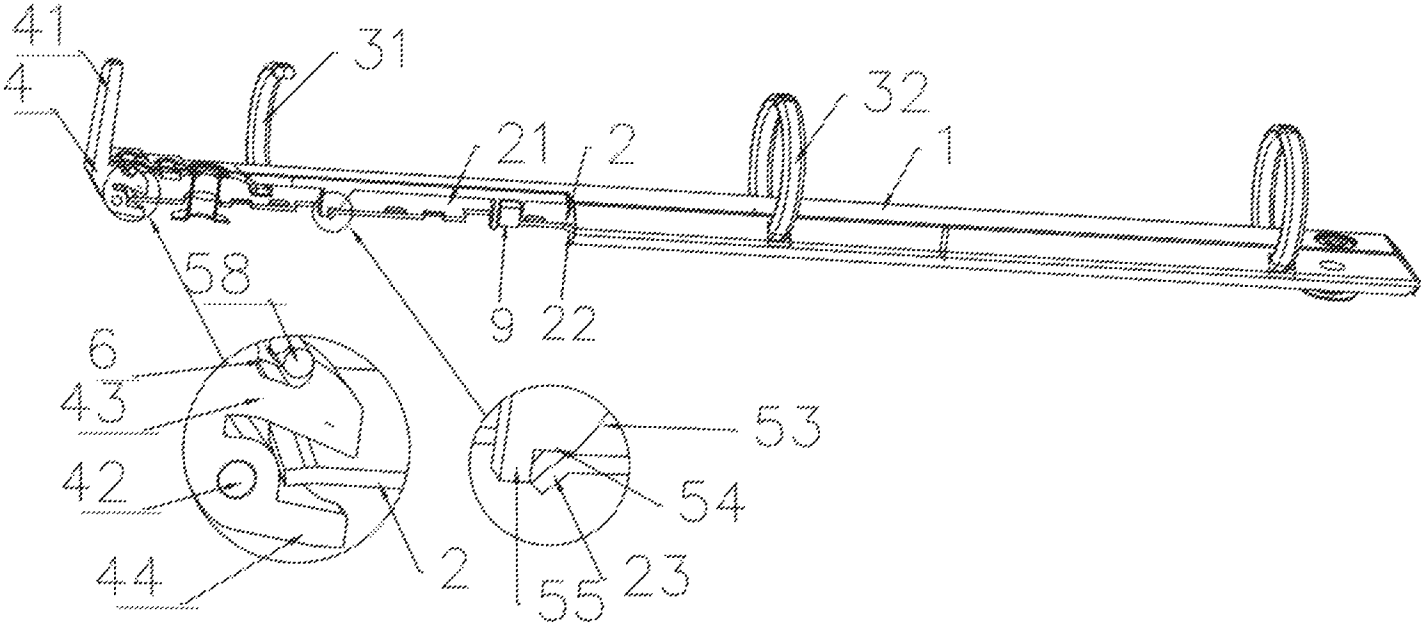
FIG. 1 is a sectional view of an embodiment 1 illustrating the state when a handle is pulled to the innermost side and a ring clamp is in the locked state.

Detailed description will be given to the present invention with reference to the accompanying drawings.

Embodiment 1:

As illustrated in FIGS. 1 to 7, the clamp ring provided by the present invention comprises a housing 1 and an articulated plate 2, wherein the articulated plate 2 consists of a first articulated plate 21 and a second articulated plate 22 which are articulated with each other; an articulated axis is disposed in the middle of the articulated plate 2; both sides of the housing 1 are bent so as to clamp the articulated plate 2 at the bottom; and both sides of the articulated plate 2 are connected with the housing 1. Moreover, the width of the housing 1 is varied along with the pivoting of the articulated plate 2. When the articulated plate 2 is at a coplanar position (namely when the first articulated plate 21 and the second articulated plate 22 are in the same plane), the housing 1 is stretched to the maximum width by the articulated plate 2. When the articulated plate 2 is pivoted (namely when the first articulated plate 21 and the second articulated plate 22 are not at the coplanar position), an included angle is formed between the first articulated plate 21 and the second articulated plate 22.

The ring clamp provided by the present invention comprises at least two rings, wherein each ring consists of a first ring member 31 and a second ring member 32. The connection mode of the first ring member 31 and the second ring member 32 may be that: the first ring member 31 is connected with the first articulated plate 21 and the second ring member 32 is connected with the second articulated plate 22. The connection mode may be also that: one ring member is connected with the articulated plate 2 and the other ring member is fixed on the housing 1. When the articulated plate 2 is pivoted, the first ring member 31 and the second ring member 32 are gradually opened or closed along with the pivoting of the articulated plate 2. After the articulated plate 2 is pivoted towards the outside of the housing 1 and crosses the coplanar position, the width of the housing 1 begins to be reduced, and the first ring member 31 and the second ring member 32 are automatically closed to form a ring under the action of the shrinkage force of the housing 1.

A handle 4 of the ring clamp is connected with the housing 1 and can drive the pivoting of the articulated plate 2. In the embodiment, the handle 4 includes a main body and a handle bar 41, wherein the main body includes an upper lip section 43 and a lower lip section 44; both the main body and the housing 1 are provided with a pivoted hole; the ring clamp further comprises a first fixing member 42 which may be a rivet; and the first fixing member 42 runs through the pivoted holes of the main body and the housing 1, so that the handle 4 is pivoted with the housing 1. When the handle bar 41 is pulled out, the lower lip section 44 rotates towards an outer surface of the articulated plate 2 and hence drives the articulated plate 2 to begin pivoting from a position at which the ring clamp is in the closed state to an inner surface of the housing 1. When the handle bar 41 is closed inwards, the upper lip section 43 is extruded towards an inner surface of the articulated plate 2 and hence drives the articulated plate 2 to cross the coplanar position from the pivoted state so as to close the ring clamp.

A slide plate 5 of the ring clamp is disposed in a gap formed by the housing 1 and the articulated plate 2, is connected with the handle 4, and can move relative to the housing 1. A locking position is disposed on a movement locus. When the ring clamp is in the closed state, the slide plate 5 moves to the locking position and abuts against the articulated plate 2 so as to lock the articulated plate 2. Moreover, the slide plate 5 can be departed from the locking position along with the pulling of the handle 4, so that the articulated plate 2 can be driven to rotate by the handle 4. In addition, the articulated plate 2 cannot be driven to be pivoted by an external force at the locking position.

The handle 4 or the slide plate 5 is provided with an idle stroke section 6, so that the slide plate 5 does not slide to the locking position along with the closing of the handle 4 in the initial phase of the closing of the ring clamp and the articulated plate 2 can cross the coplanar position along with the closing of the handle 4. In the embodiment, the slide plate 5 is connected with the idle stroke section 6 of the handle 4; and the idle stroke section is a recess formed on the main body of the handle 4. The slide plate 5 is disposed on the articulated plate 2; the idle stroke section 6 is disposed on the upper lip section 43; and the slide plate 5 is provided with a sleeve shaft 58 which is sleeved in the idle stroke section 6. Therefore, the handle 4 can drive the slide plate 5 to slide.

The ring clamp is provided with a magnetic structure. The magnetic structure is specifically set to be: the slide plate 5 and the articulated plate 2 or the slide plate 5 and the housing 1. After the articulated plate 2 crosses the coplanar position along with the closing of the handle 4, the slide plate 5 is adsorbed to the locking position by the magnetic force generated by the magnetic structure, so that the articulated plate 2 can be locked. The magnetic structure may be a combination of magnets and may also be a combination of magnets and ferrous metals. The ferrous metals may be common iron, cobalt and nickel.

As illustrated in FIGS. 1 to 6, the slide plate 5 of the embodiment includes a connecting rod 51 connected with the handle 4 and a locking member 52 projected on the connecting rod 51. In the embodiment, the locking member 52 includes a buffer section 53, an abutting section 54 and a barrier section 55 which are connected with each other in sequence, wherein the projected height of the barrier section 55 is greater than that of the abutting section 54; one end of the buffer section 53 is connected with the connecting rod 51 and the other end of the buffer section 53 is connected with one side of the abutting section 54 away from the handle 4; a surface of the buffer section 53 is oblique; the articulated plate 2 is provided with a first through hole through which the locking member 52 slides in the direction of an end portion of the articulated plate 2; and a sliding section 23 which is engaged with the oblique buffer section 53 is projected on one side of the first through hole close to the buffer section 53. When the ring clamp is in the closed state, the articulated plate 2 abuts against the abutting section 54 and the sliding section 23 is blocked by the barrier section 55. When the ring clamp is converted from the closed state to the opened state, the sliding section 23 slides across the buffer section 53 until the articulated plate 2 abuts against the connecting rod 51. Due to the abutting section 54, the articulated plate 2 is locked after the ring clamp is closed and cannot be pushed by an external force directly applied to the articulated plate 2 from any direction, and hence the ring members of the ring clamp provided by the present invention cannot be opened in the case of accidental dropping and the like. Due to the design of the buffer section 53 and the sliding section 23, the articulated plate 2 cannot directly jump from the abutting section 54 to the connecting rod 51 but smoothly slides down in the process of opening the ring clamp, so that more comfortable user experience can be obtained.

In the embodiment, a square fixed frame 56 which is integrally formed with the slide plate 5 is projected on the connecting rod 51 of the slide plate 5; and both the slide plate 5 and the fixed frame 56 are made of plastic materials. The ring clamp further comprises a magnetic member 9 fixed on the fixed frame 56. More specifically, the magnetic member 9 is a square magnet. The fixed frame 56 includes four stators surrounding the magnet, wherein the height of the stator away from the handle 4 is less than that of the magnetic member 9, and the height of the other three stators is greater than that of the magnetic member 9. The articulated plate 2 is made of ferrous metals and provided with a second through hole through which the fixed frame 56 slides in the direction of the end portion of the articulated plate 2. After the articulated plate 2 crosses the coplanar position along with the closing of the handle 4, the magnetic member 9 is adsorbed to an edge of the second through hole away from the handle 4. Therefore, the magnetic force of the magnetic member 9 in three directions can be shielded by the three stators with large height and the magnetic member can only be adsorbed to the edge of the second through hole away from the handle 4.

After the articulated plate 2 crosses the coplanar position along with the closing of the handle 4 and achieves automatic closing of the clamp, the sleeve shaft 58 sleeved in the idle stroke section 6 cannot be returned back to the locking position along with the closing of the handle 4 in the initial phase of the closing of the clamp, and the slide plate 5 must be adsorbed to the locking position via the magnetic force between the magnet and the ferrous articulated plate 2. In order to obtain enough large magnetic force, the magnetic members 9 may be disposed at a plurality of positions of the connecting rod 51. In the embodiment, the magnetic members 9 are disposed at two positions. The action matching relationships of partial components of the embodiment in various movement states are summarized as follows.

As illustrated in FIG. 1, state 1: when the handle 4 is pulled to the innermost side and the ring clamp is in the locked state, the upper lip section 43 of the handle 4 abuts against or is close to the inner surface of the articulated plate 2; the abutting section 54 of the locking member 52 abuts against the articulated plate 2; the barrier section 55 abuts against the sliding section 23 of the articulated plate 2; the articulated plate 2 crosses the coplanar position and cannot be pivoted; and the sleeve shaft 58 is adsorbed to the end portion of the idle stroke section 6 away from the handle 4 from the end portion of the idle stroke section 6 close to the handle 4 due to the magnetic force.

Figure 2:
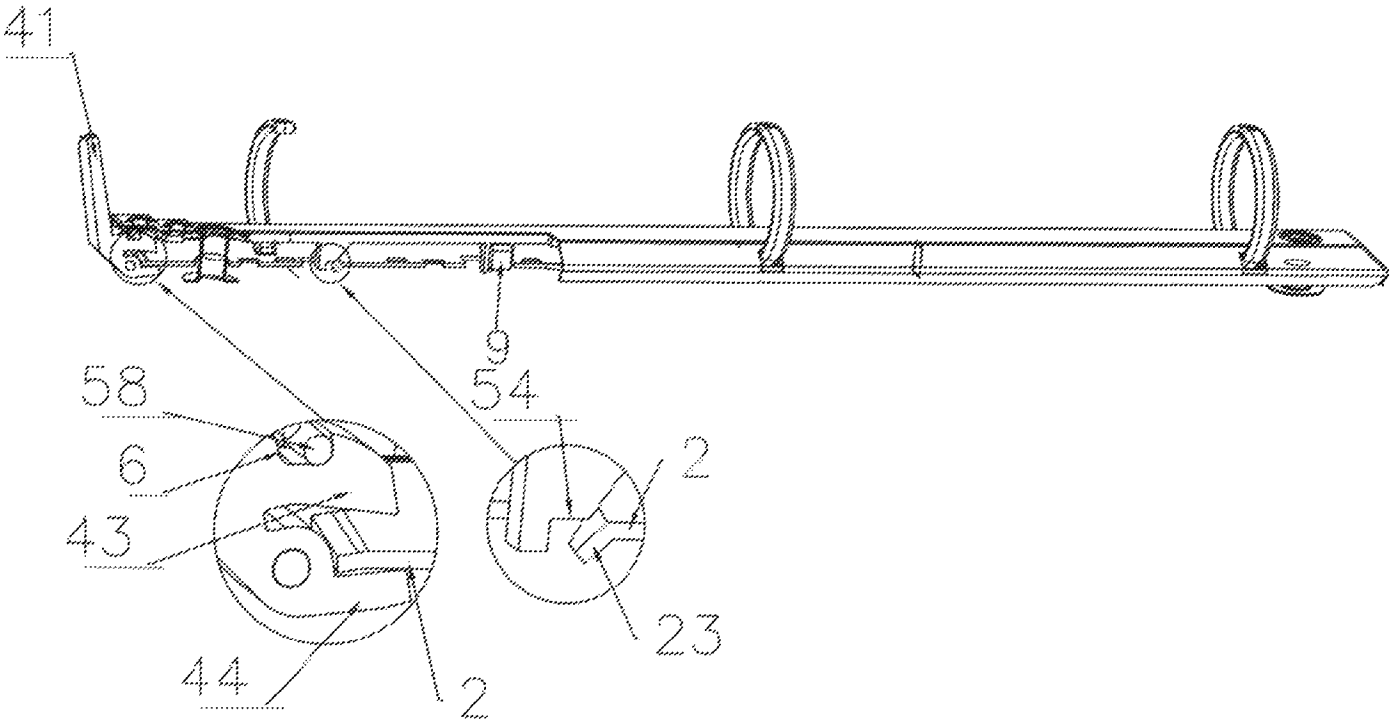
FIG. 2 is a sectional view of the embodiment 1 illustrating the state when the handle is pulled out from the innermost side and the ring clamp is also in the closed state.

As illustrated in FIG. 2, state 2: when the handle 4 is pulled out from the innermost side and the ring clamp is also in the closed state, the lower lip section 44 of the handle 4 does not contact or just contacts the lower surface of the articulated plate; the abutting section 54 of the locking member 52 begins to be departed from the articulated plate 2; the articulated plate 2 is at the coplanar position or is slightly pivoted towards the inner surface of the housing 1; and the sleeve shaft 58 is still disposed on the end portion of the idle stroke section 6 away from the handle 4 and is tightly sleeved with the handle 4.

Figure 3:
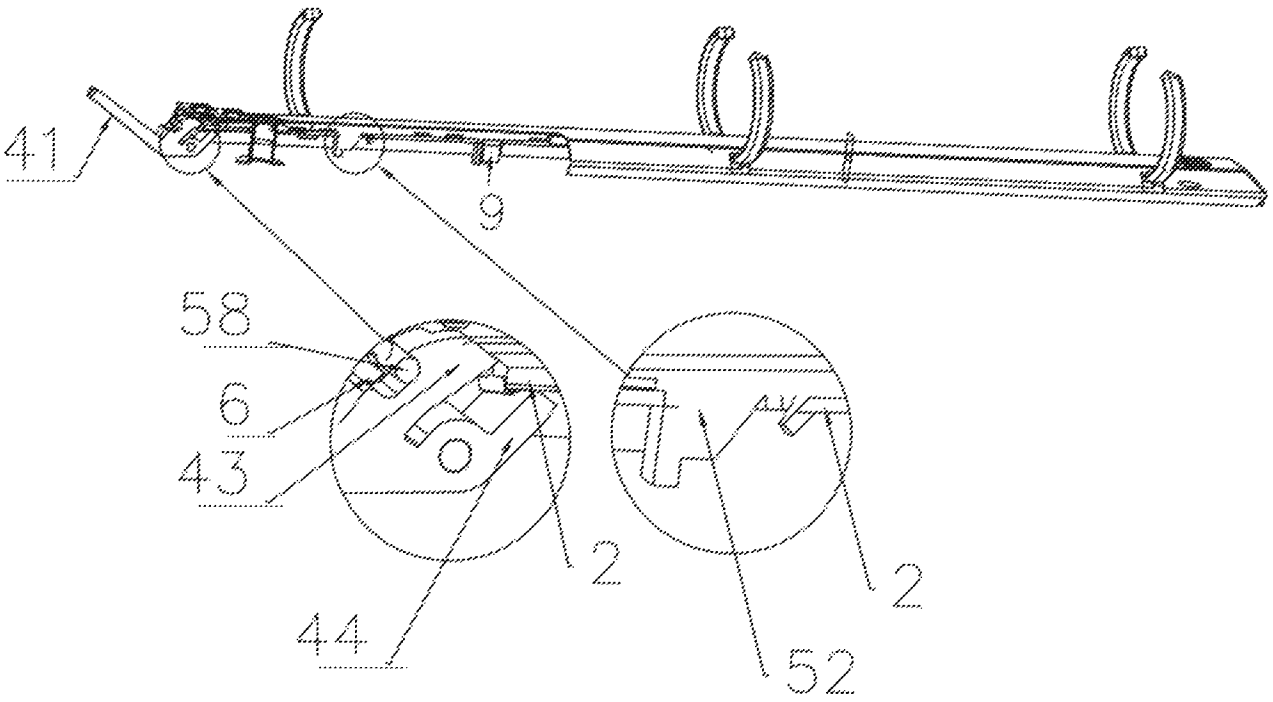
FIG. 3 is a sectional view of the embodiment 1 illustrating the state when the handle is pulled to the outermost side and the ring clamp is in the opened state.

As illustrated in FIG. 3, state 3: when the handle 4 is pulled to the outermost side and the ring clamp is in the opened state, the lower lip section 44 of the handle 4 abuts against the lower surface of the articulated plate 2; the abutting section 54 of the locking member 52 is completely departed from the articulated plate 2; the articulated plate 2 is pivoted to a limiting angle thereof; and the sleeve shaft 58 is still disposed on the end portion of the idle stroke section 6 away from the handle 4.

Figure 4:
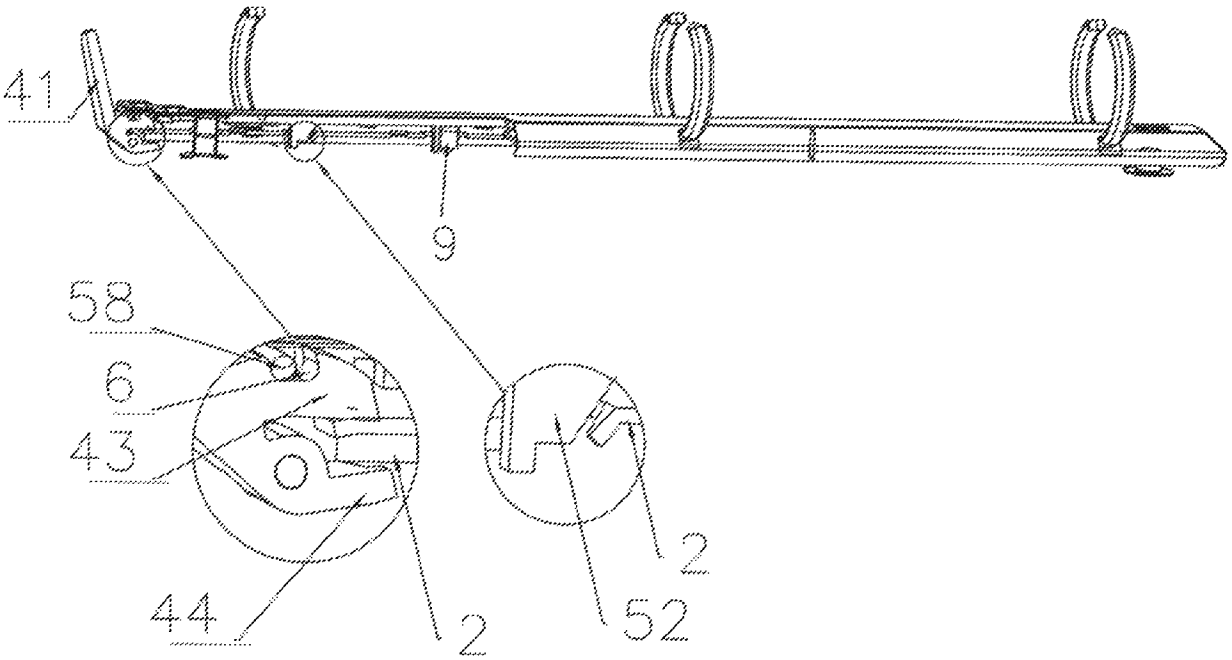
FIG. 4 is a sectional view of the embodiment 1 illustrating the state when the handle is closed inwards from the outermost side and the ring clamp is in the opened state.

As illustrated in FIG. 4, state 4: when the handle 4 is closed inwards from the outermost side and the ring clamp is in the opened state, the slide plate does not move; the upper lip section 43 of the handle 4 is going to abut against or just abuts against the upper surface of the articulated plate 2; the sliding section 23 of the articulated plate 2 moves close to the locking member 52; and the sleeve shaft 58 moves towards the end portion of the idle stroke section 6 close to the handle 4 along with the closing of the handle 4.

Figure 5:
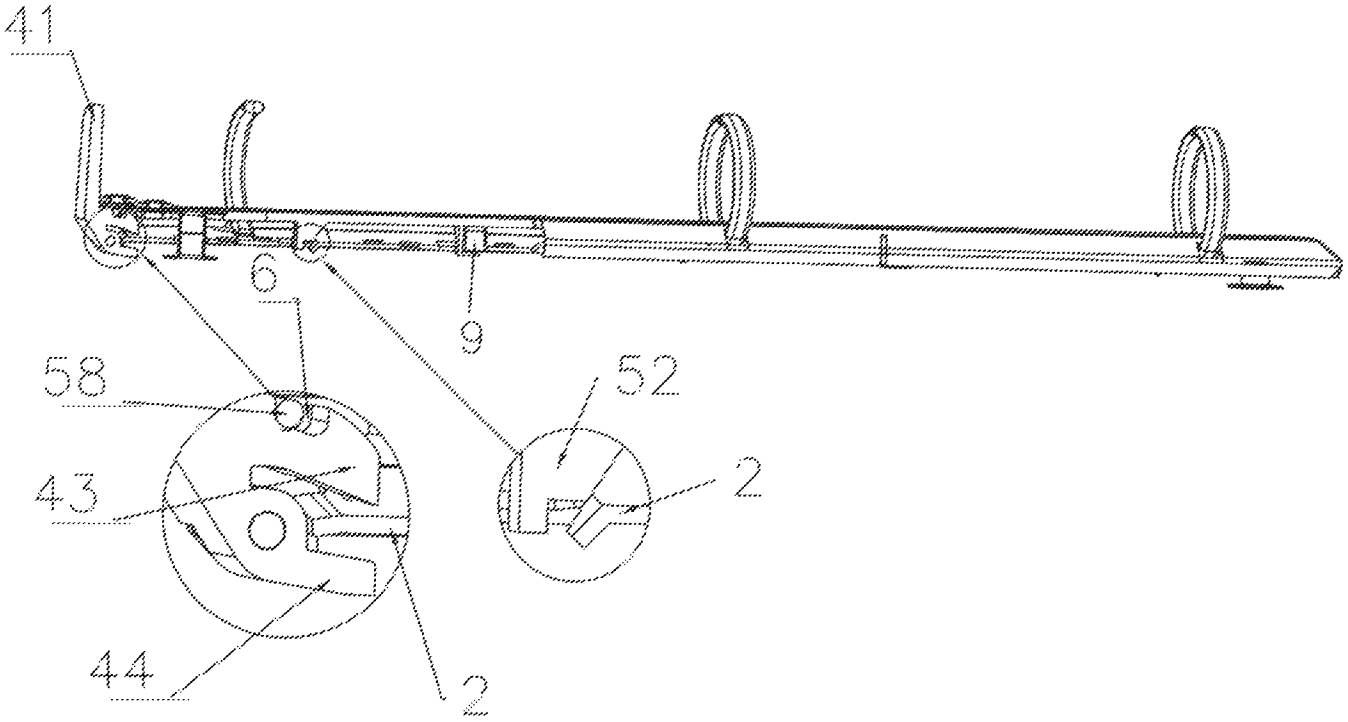
FIG. 5 is a sectional view of the embodiment 1 illustrating the state when the handle is closed inwards from the outermost side and the ring clamp is just in the closed state.
Figure 6:
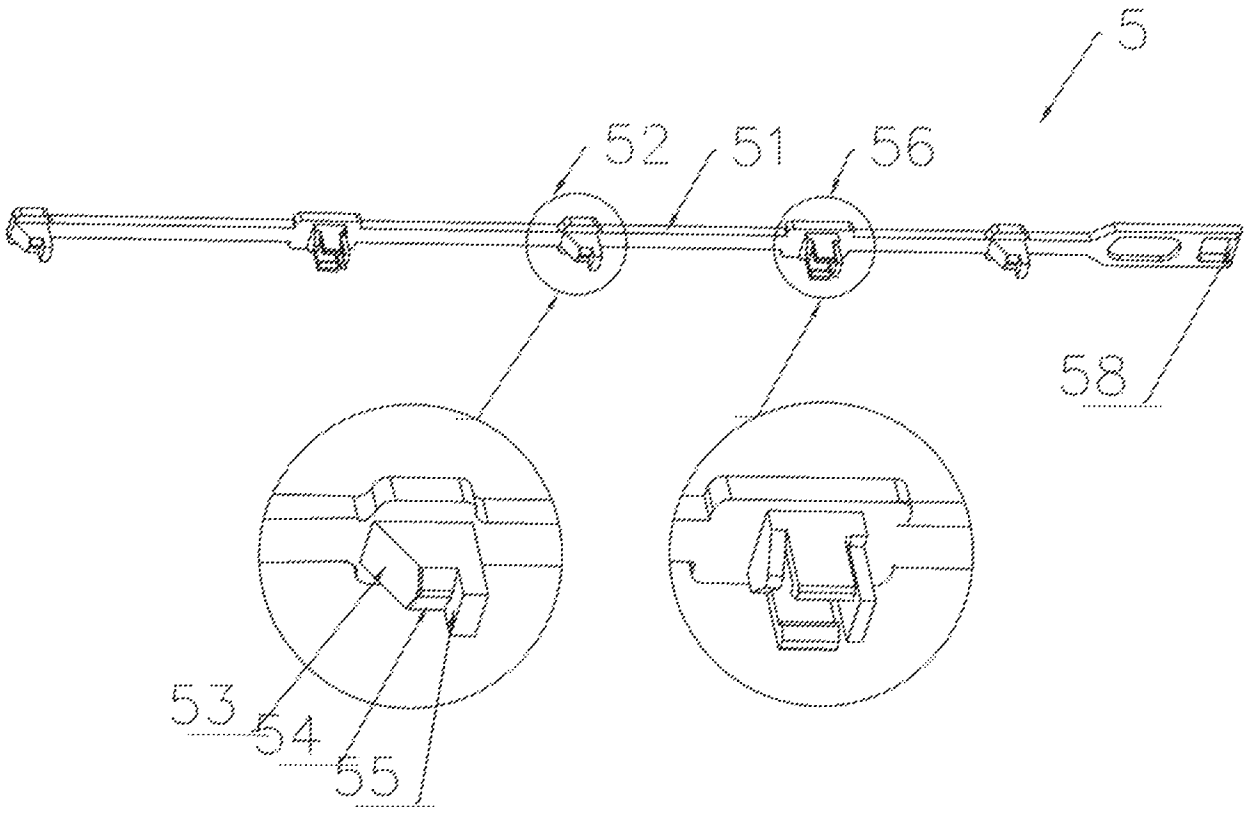
FIG. 6 is a schematic structural view of a slide plate of the embodiment 1.
Figure 7:
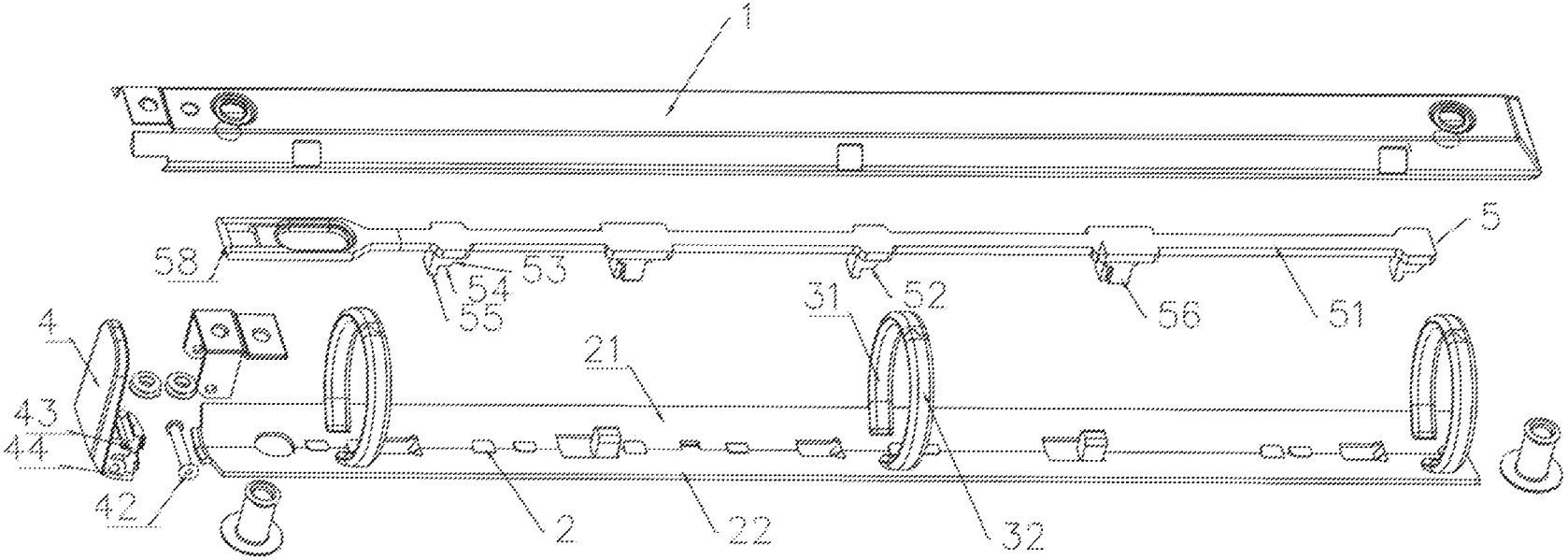
FIG. 7 is an exploded view of the embodiment 1.

As illustrated in FIG. 5, state 5: when the handle 4 is closed inwards from the outermost side and the ring clamp is just in the closed state, the upper lip section 43 of the handle 4 just abuts against the upper surface of the articulated plate 2; the sliding section 23 of the articulated plate 2 is extremely close to the locking member 52 but the abutting section 54 does not abut against the articulated plate 2; the articulated plate 2 is almost at the coplanar position; and the sleeve shaft 58 begins to move towards the end portion of the idle stroke section 6 close to the handle 4.

Figure 8:
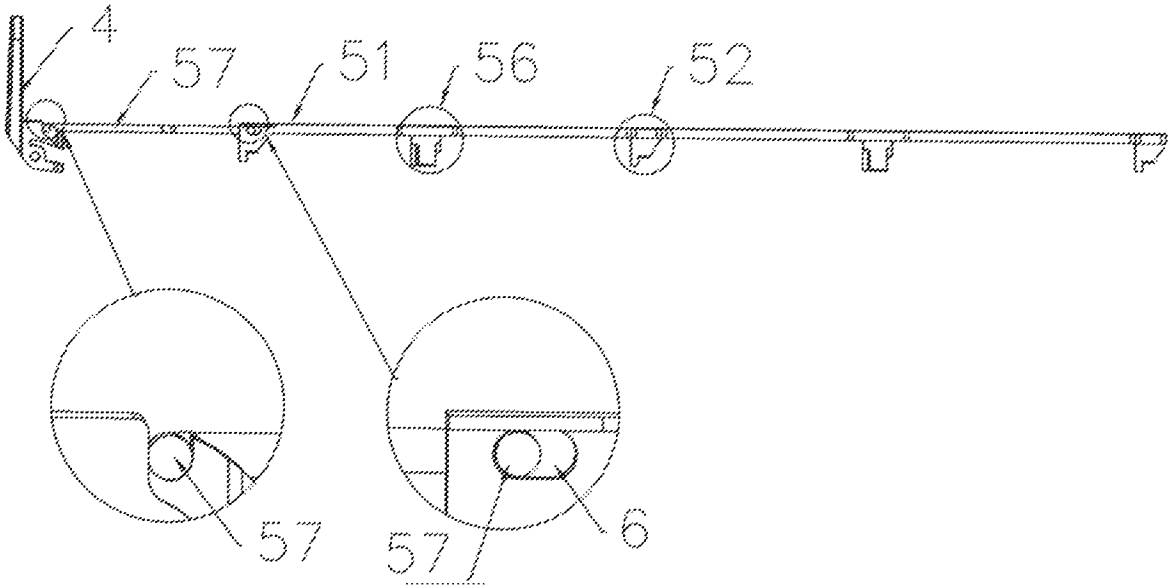
FIG. 8 is a schematic structural view of a slide block connected with the handle, in the embodiment 2.

Embodiment 2:

As illustrated in FIG. 8, the differences of the embodiment with the embodiment 1 are as follows: the slide plate 5 further includes a tension rod 57; the idle stroke section 6 is disposed on the connecting rod 51 of the slide plate 5; and one end of the tension rod 57 is tightly connected with the handle 4 and the other end of the tension rod 57 is connected with the idle stroke section 6 of the connecting rod 51. The idle stroke section 6 is, more specifically, a through hole formed on the connecting rod 51. As the idle stroke section 6 is disposed on the slide plate 5, the manufacturing precision can be more easily controlled compared with the case that the idle stroke section 6 is disposed on the handle 4. Other structures of the embodiment 2 are the same with those of the embodiment 1 and will not be further described herein.

Figure 9:
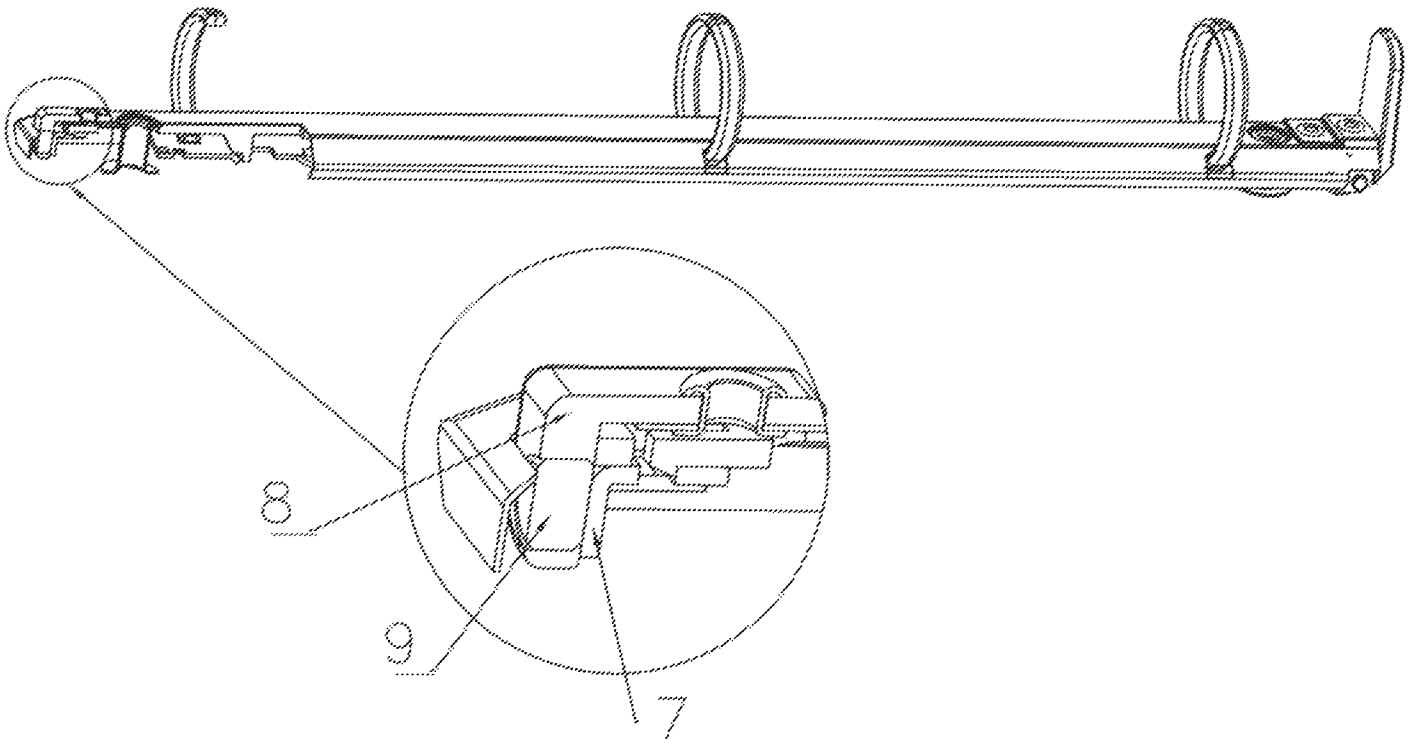
FIG. 9 is a sectional view of an embodiment 3 in which a first adsorbing member is a magnetic member and a second adsorbing member is an angle iron.

Embodiment 3:

As illustrated in FIG. 9, the differences of the embodiment with the embodiment 1 are as follows: a first adsorbing member, i.e. a magnetic member 9, is disposed on the end portion of the housing 1 away from the handle 4; and a second adsorbing member, i.e. an angle iron 7, made of ferrous metals, is fixed on the end portion of the slide plate 5 facing the magnet. More specifically, in the embodiment, the ring clamp further comprises a rubber magnet support 8 and a second fixing member configured to fix the rubber magnet support 8 on the housing 1, wherein the rubber magnet support 8 is provided with a fixing hole; the magnetic member 9 is fixed in the fixing hole; and the second fixing member may be a rivet. Compared with the case that the magnetic member 9 is fixed on the slide plate 5, the mounting space of the embodiment is larger. Other structures of the embodiment 3 are the same with those of the embodiment 1 and will not be further described herein.

Figure 10:
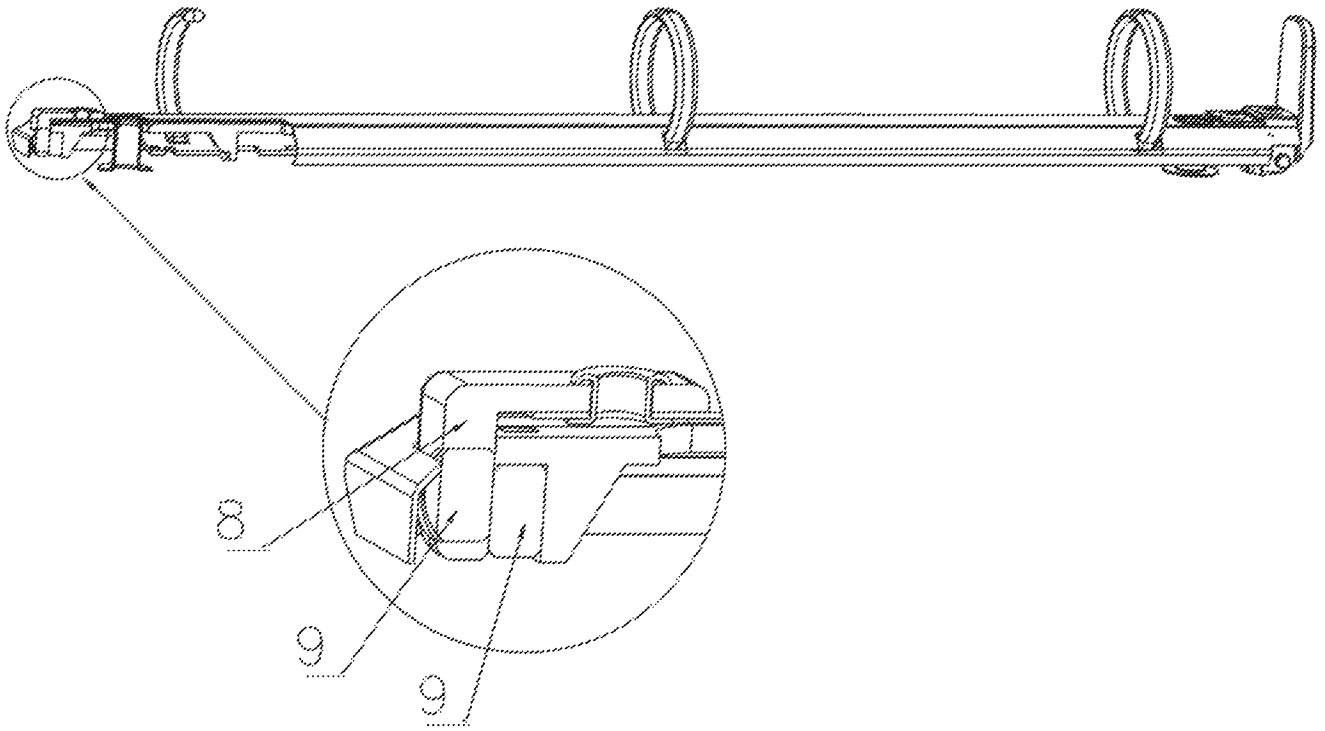
FIG. 10 is a sectional view of an embodiment 4 in which a first adsorbing member is a magnetic member and a second adsorbing member is a magnetic member.

Embodiment 4:

As illustrated in FIG. 10, the differences of the embodiment with the embodiment 3 are as follows: a first adsorbing member, i.e. a magnetic member 9, is disposed on the end portion of the housing 1 away from the handle 4; and a second adsorbing member, i.e. a magnetic member 9, is fixed on the end portion of the slide plate 5 facing the magnet. The magnetism of the embodiment is stronger than that of the embodiment 3. Other structures of the embodiment 4 are the same with those of the embodiment 3 and will not be further described herein.

Figure 11:
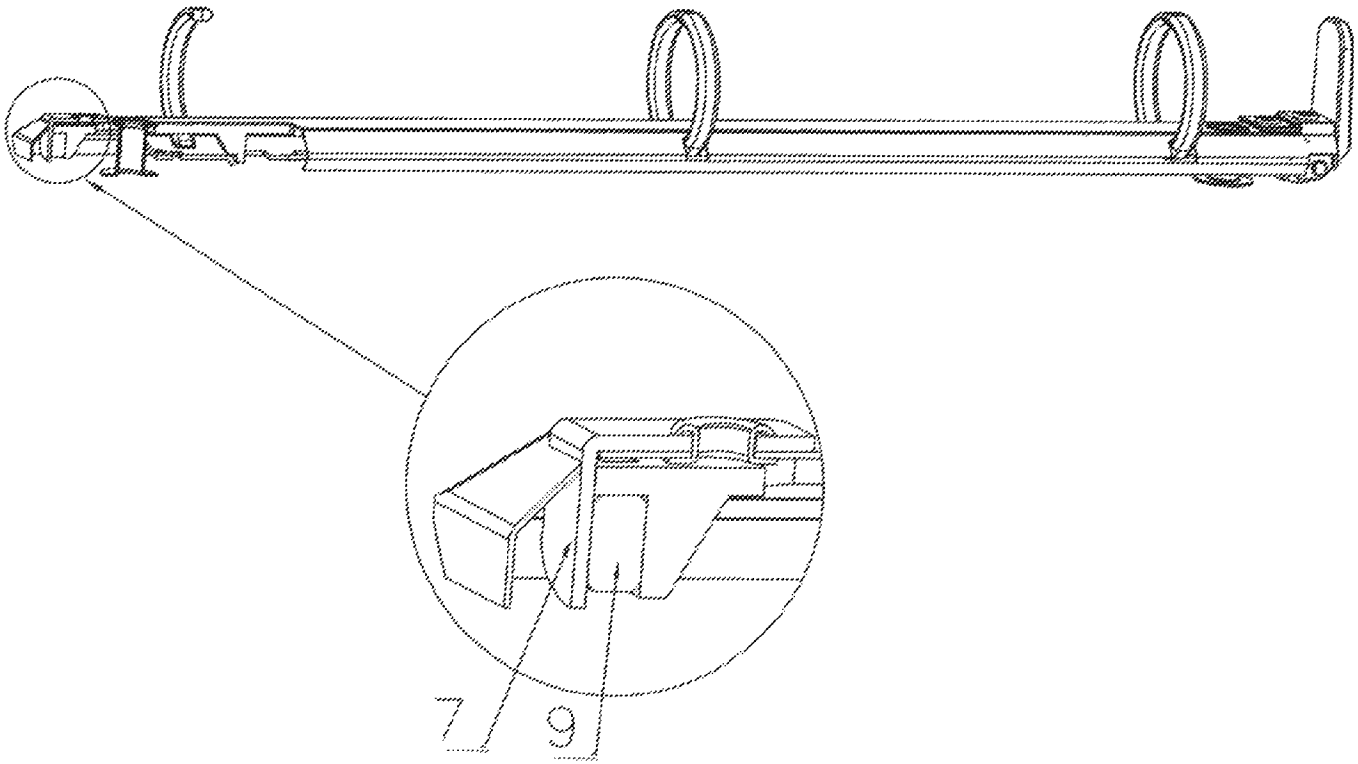
FIG. 11 is a sectional view of an embodiment 5 in which a first adsorbing member is an angle iron and a second adsorbing member is a magnetic member.

Embodiment 5:

As illustrated in FIG. 11, the differences of the embodiment with the embodiment 3 are as follows: a first adsorbing member, i.e. an angle iron 7, is fixed on one end of the housing 1 away from the handle 4; and a second adsorbing member, i.e. a magnetic member 9, is fixed on the end portion of the slide plate facing the angle iron 7. Compared with the embodiment 3, the rubber magnet support 8 is not required in the embodiment, so that the production cost can be saved. Other structures of the embodiment 5 are the same with those of the embodiment 3 and will not be further described herein.

Figure 12:
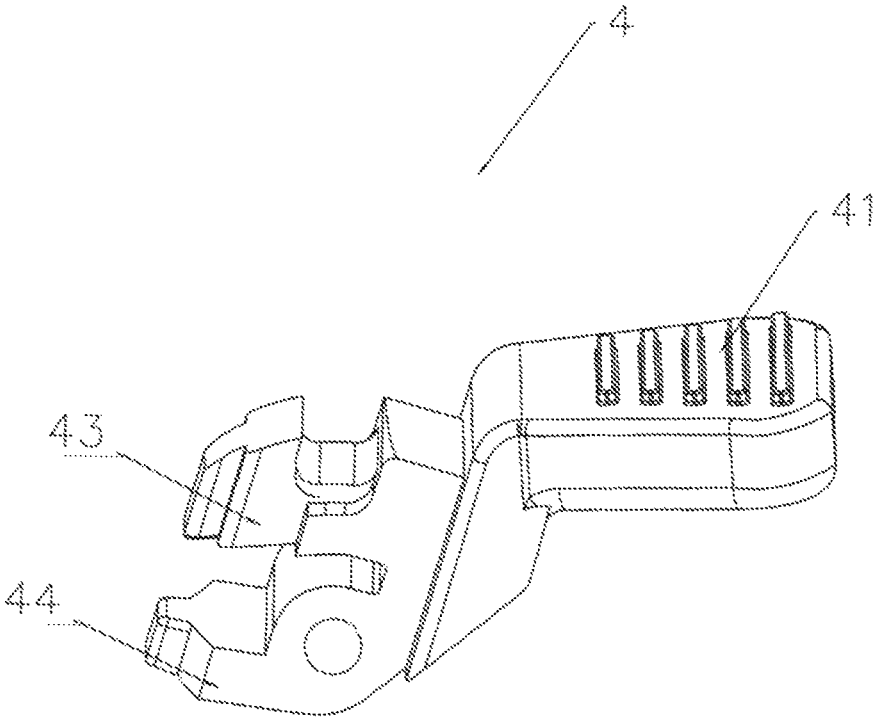
FIG. 12 is a schematic structural view of a handle of an embodiment 6.

Embodiment 6:

As illustrated in FIG. 12, as a further improvement of the above five embodiments, the structure of the handle 4 may be as follows: the handle 4 includes a main body and a handle bar 41, wherein one end of the handle bar 41 is connected with the main body and the other end of the handle bar 41 is extended to the back side of the main body and forms an included angle of approximately 90 degrees with the main body; and the main body includes an upper lip section 43 and a lower lip section 44. The handle bar 41 of the embodiment is handled by pressing, which is adapted to various operation habits of users.

Compared with the prior art, the clamp ring provided by the present invention does not need to overcome the tension generated by the deformation of the intermediate connector so as to close the ring clamp, and hence the closing action is more laborsaving and the ring clamp is more convenient to use. Meanwhile, as each closing action of the ring clamp structure in the prior art must utilize the deformation of the intermediate connector to generate the tension, the service life of the intermediate connector can be greatly affected. Particularly, along with the aging of plastic materials and the operation of the ring clamp under the environment of low temperature, the intermediate connector can be more easily fractured during the deformation, and hence the service life of the ring clamp structure can be seriously reduced. But in the present invention, due to the matching design of the idle stroke section 6 and the magnetic structure, the slide plate 5 is adsorbed to the locking position by the magnetic force when the ring clamp is in the closed state, and hence the magnetic structure of the ring clamp cannot be damaged after long-term use, and consequently the service life of the ring clamp provided by the present invention can be prolonged.

The foregoing is only the preferred embodiments of the present invention. Modifications can be made to the specific embodiments and the application range by those skilled in the art on the basis of the concept of the present invention. The content of the description should not be construed as the limiting of the present invention.

What is claimed is:

1. A novel ring clamp, comprising:

a housing;

an articulated plate, in which the articulated plate consists of a first articulated plate and a second articulated plate which are articulated with each other; an articulated axis is disposed in the middle of the articulated plate; the first articulated plate and the second articulated plate are pivoted relative to the articulated axis; and both sides of the articulated plate are connected with the housing;

at least two rings, in which each ring consists of a first ring member and a second ring member; the first ring member and/or the second ring member are/is connected with the articulated plate; when the articulated plate is pivoted, the first ring member and the second ring member are opened or closed along with the pivoting of the articulated plate; and after the articulated plate is pivoted towards the outside of the housing and crosses a coplanar position, the first ring member and the second ring member are closed to form a ring;

a handle, in which the handle is connected with the housing and can drive the pivoting of the articulated plate; and a slide plate, in which the slide plate is arranged between the housing and the articulated plate, is connected with the handle, and can move relative to the housing; a locking position is disposed on a movement locus; when the ring clamp is in the closed state, the slide plate moves to the locking position and abuts against the articulated plate so as to lock the articulated plate; and the slide plate can be departed from the locking position along with the pulling of the handle, so that the articulated plate can be driven to rotate by the handle;

wherein the handle or the slide plate is provided with an idle stroke section, so that the slide plate does not slide towards the locking position along with the closing of the handle in the initial phase of the closing of the ring clamp;

the ring clamp is provided with a magnetic structure; and after the articulated plate crosses the coplanar position along with the closing of the handle, the slide plate is adsorbed to the locking position by the magnetic force generated by the magnetic structure, so that the articulated plate can be locked.

2. The novel ring clamp according to claim 1, wherein the slide plate includes a connecting rod connected with the handle and a locking member projected on the connecting rod; the locking member includes an abutting section; the articulated plate is provided with a first through hole through which the locking member slides in the direction of an end portion of the articulated plate; and when the ring clamp is in the closed state, the articulated plate abuts against the abutting section, so that the articulated plate is locked and cannot be pivoted.

3. The novel ring clamp according to claim 2, wherein the locking member further includes a buffer section; one end of the buffer section is connected with the connecting rod and the other end of the buffer section is connected with one side of the abutting section away from the handle; and a sliding section which is engaged with the oblique buffer section is disposed on one side of the first through hole close to the buffer section.

4. The novel ring clamp according to claim 2, wherein the slide plate further includes a tension rod; the idle stroke section is disposed on the connecting rod of the slide plate; and one end of the tension rod is connected with the handle and the other end of the tension rod is connected with the idle stroke section of the connecting rod.

5. The novel ring clamp according to claim 2, wherein a square fixed frame is projected on the connecting rod of the slide plate; the fixed frame and the slide plate are integrally formed; both the slide plate and the fixed frame are made of plastic materials; the ring clamp further comprises a magnetic member disposed on the fixed frame; the fixed frame is formed by four stators; the height of the stator away from the handle is less than that of the magnetic member, and the height of the remaining three stators is greater than that of the magnetic member; the articulated plate is made of ferrous metals and provided with a second through hole through which the fixed frame slides in the direction of the end portion of the articulated plate; and after the articulated plate crosses the coplanar position along with the closing of the handle, the magnetic member is adsorbed to an edge of the second through hole away from the handle.

6. The novel ring clamp according to claim 1, wherein the handle includes a main body and a handle bar connected with the main body; the main body includes an upper lip section and a lower lip section; both the main body and the housing are provided with a pivoted hole; the ring clamp further comprises a first fixing member; the first fixing member runs through the pivoted holes of the main body and the housing, so that the handle is pivoted with the housing; when the handle bar is pulled out, the lower lip section rotates towards an outer surface of the articulated plate and hence drives the articulated plate to begin pivoting from a position at which the ring clamp is in the closed state; and when the handle bar is closed inwards, the upper lip section is extruded towards an inner surface of the articulated plate and hence drives the articulated plate to cross the coplanar position from the pivoted state so as to close the ring clamp.

7. The novel ring clamp according to claim 6, wherein the idle stroke section is disposed on the main body of the handle and disposed on the upper lip section.

8. The novel ring clamp according to claim 1, wherein a first adsorbing member is disposed on an end portion of the housing away from the handle; and a second adsorbing member which adsorbs the first adsorbing member mutually is fixed on an end portion of the slide plate facing the first adsorbing member.

9. The novel ring clamp according to claim 8, wherein a rubber magnet support is also disposed on the end portion of the housing away from the handle; the novel ring clamp further comprises a second fixing member configured to fix the rubber magnet support on the housing; the rubber magnet support is provided with a fixing hole; and the magnetic member is fixed in the fixing hole.

* * * * *